US006860787B1

(12) United States Patent
Woodhouse

(10) Patent No.: US 6,860,787 B1
(45) Date of Patent: Mar. 1, 2005

(54) TOY HAVING A SIMULATED CLIMBING FIGURE

(75) Inventor: Hampton R. Woodhouse, Hope, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/403,684

(22) Filed: Mar. 31, 2003

(51) Int. Cl.[7] ..... A63H 3/00
(52) U.S. Cl. ..... 446/268; 446/309
(58) Field of Search ..... 446/139, 308, 446/309, 311, 268

(56) References Cited

U.S. PATENT DOCUMENTS

| | | | | |
|---|---|---|---|---|
| 163,696 | A | | 5/1875 | Safford |
| 362,238 | A | | 5/1887 | Whitney |
| 647,327 | A | | 4/1900 | Rehlin |
| 2,403,509 | A | | 7/1946 | Dise |
| 2,658,495 | A | * | 11/1953 | Elliot ..... 124/7 |
| 3,715,121 | A | | 2/1973 | Renn et al. |
| 3,839,820 | A | | 10/1974 | Serman, Jr. |
| 4,177,992 | A | * | 12/1979 | Todokoro ..... 273/357 |
| 5,150,898 | A | * | 9/1992 | Hochberg et al. ..... 273/317.3 |
| 5,458,523 | A | * | 10/1995 | Aoki et al. ..... 446/246 |
| 5,657,995 | A | | 8/1997 | Howard |
| 5,690,330 | A | | 11/1997 | Ozawa |
| 5,851,012 | A | * | 12/1998 | Langieri, Jr. et al. .... 273/317.1 |
| 6,343,969 | B1 | | 2/2002 | Spector |

FOREIGN PATENT DOCUMENTS

GB 2105205 A * 3/1983 ..... A63H/33/00

* cited by examiner

*Primary Examiner*—Derris H. Banks
*Assistant Examiner*—Ali Abdelwahed
(74) *Attorney, Agent, or Firm*—Marshall, Gerstien & Borun LLP

(57) ABSTRACT

A toy having a simulated climbing figure comprises a figure including a magnet, a launching unit including a platform for receiving the figure, with the platform shiftable between a stationary position and a launch position to permit figure to be launched from the launching unit along a trajectory. A structure is placeable in the trajectory and includes a generally vertical component, with the structure having a ferrous metal element disposed generally adjacent the generally vertical component. The magnet of the figure and the element of the structure are arranged to enable the figure to be retained on the structure.

20 Claims, 8 Drawing Sheets

TOY HAVING A SIMULATED CLIMBING FIGURE

BACKGROUND OF THE INVENTION

The present invention is directed to a toy having a simulated climbing figure that is launchable toward a structure and that engages the structure to simulate a climbing action.

Action figures and similar toys are known in the art. Many such action figures have experienced commercial success, and manufacturers continually search for ways to enhance the play value of such action figures by providing various accessories. For example, U.S. Pat. No. 647,327 to Rehlin discloses a toy having a figure with a magnetic head. The figure is launched vertically using a pneumatic launcher toward a horizontal pole, and is retained on the pole upon contact.

U.S. Pat. No. 5,690,330 is also if interest, and discloses a figure having a spring-loaded limb, with the figure being launched toward a target upon release of a catch. The figure is not retained on the target after contact.

SUMMARY OF THE INVENTION

In one aspect, a toy having a simulated climbing figure comprises a figure including a magnet, a launching unit including a platform for receiving the figure, with the platform shiftable between a stationary position and a launch position to permit figure to be launched from the launching unit along a trajectory. A structure is placeable in the trajectory and includes a generally vertical component, with the structure having a ferrous metal element disposed generally adjacent the generally vertical component. The magnet of the figure and the element of the structure are arranged to enable the figure to be retained on the structure.

In further accordance with a disclosed example, the launching unit includes a base and the platform is pivotally mounted to the base, and an actuating lever is arranged to shift the platform from the stationary position to the launch position. The actuating lever may be pivotally mounted to the base and includes a camming portion that operatively engages the platform. The figure and the launching unit preferably are provided with cooperating pin-in-hole connections or other releasable connections to retain the figure on the launching unit when the platform is in the stationary position.

The figure preferably includes a pair of arms, with a magnet disposed on each of the arms. The structure may comprise a column, and may include a lower portion and a telescoping upper portion, with the upper portion shiftable between a lowered position in which the upper portion is disposed substantially inside of the lower portion and a raised position in which the upper portion extends from the lower portion. The structure may also include a catch to retain the upper portion in the raised position, and the upper portion may be rotatable relative to the lower portion.

In another aspect of the invention, a toy comprises a figure, a launching unit including a platform for receiving the figure, the platform shiftable between a stationary position and a launch position to permit figure to be launched from the launching unit along a trajectory, and a structure placeable in the trajectory and having a generally vertical component. Each of the figure and the vertical component of the structure are provided with cooperating engaging elements, the engaging elements arranged to enable the figure to be retained on the vertical component of the structure.

In yet another aspect of the invention, a toy comprises a figure having a pair of moveable limbs, a launching unit including a platform for supporting the figure, the platform including a lever arranged to shift the platform between a stationary position and a launch position to permit the figure to be launched from the launching unit along a trajectory, and a receiving structure placeable in the trajectory and having a surface arranged to the limbs of the figure. The moveable limbs of the figure and the surface of the structure are provided with cooperating engaging elements, the engaging elements arranged to enable the figure to be retained on the surface of the structure.

DETAILED DESCRIPTION OF VARIOUS EMBODIMENTS

Figure 1:
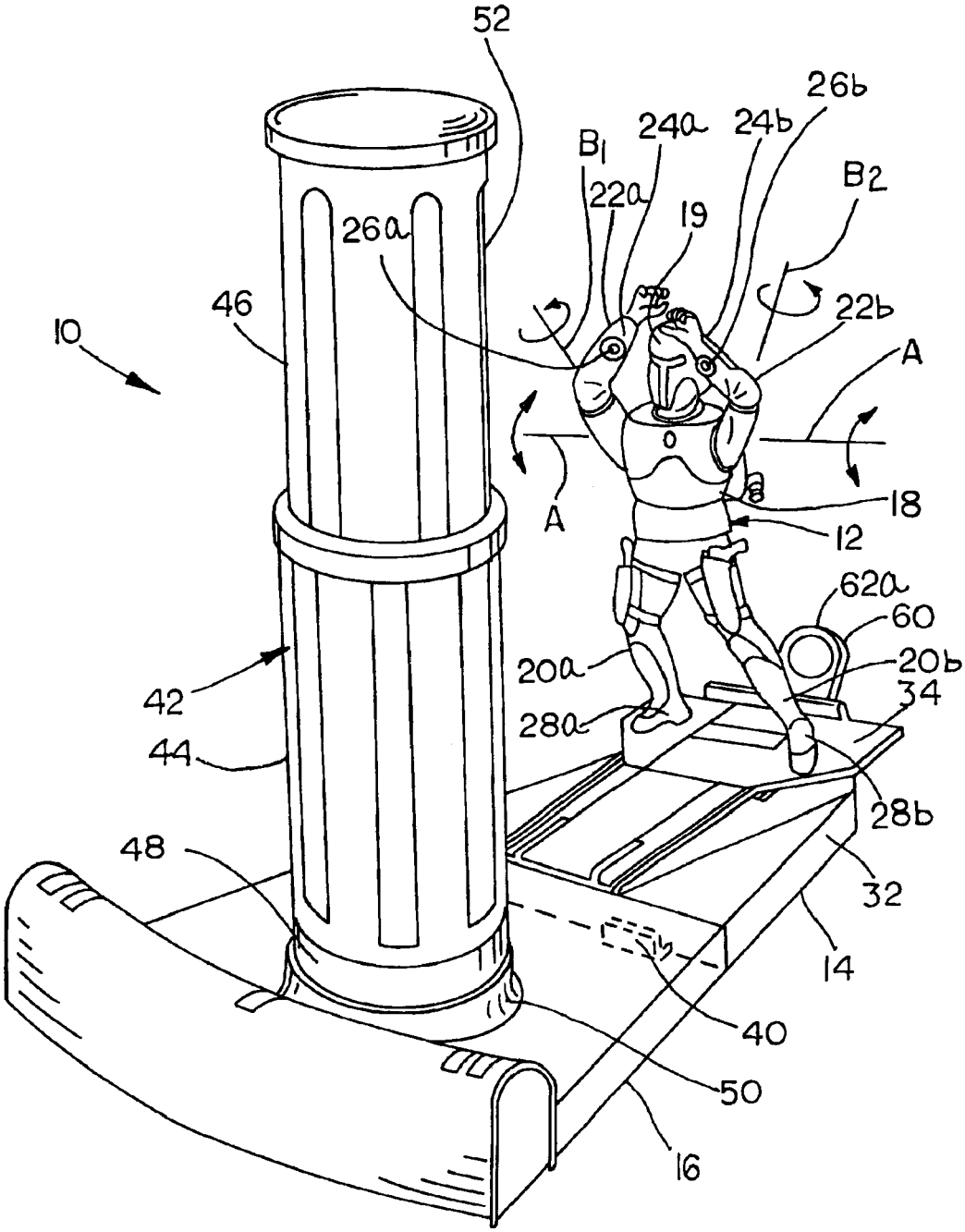
FIG. 1 is a perspective view of one embodiment of a simulated climbing toy in accordance with the an aspect of the invention.
Figure 2:
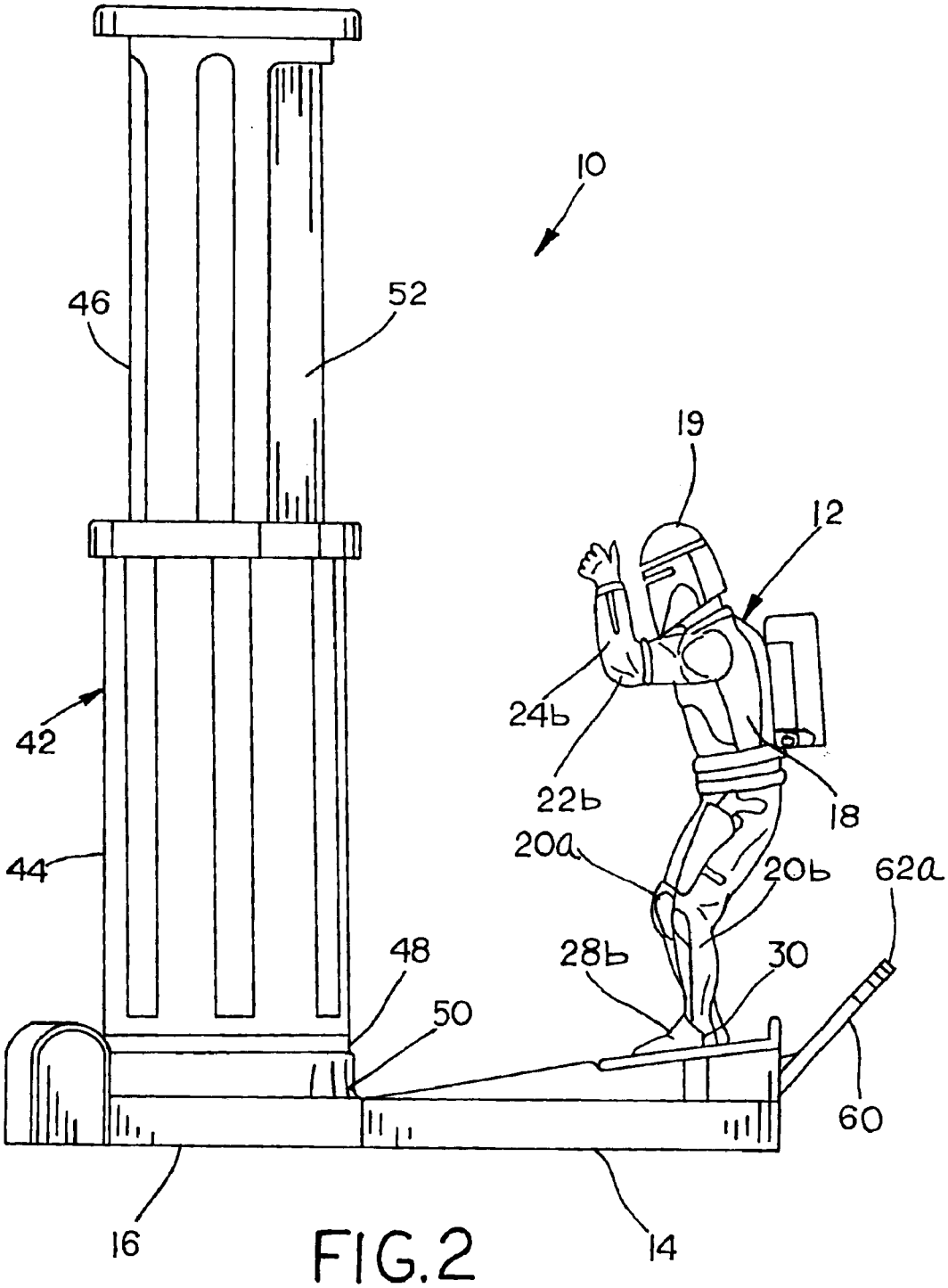
FIG. 2 is an elevational view thereof.
Figure 3:
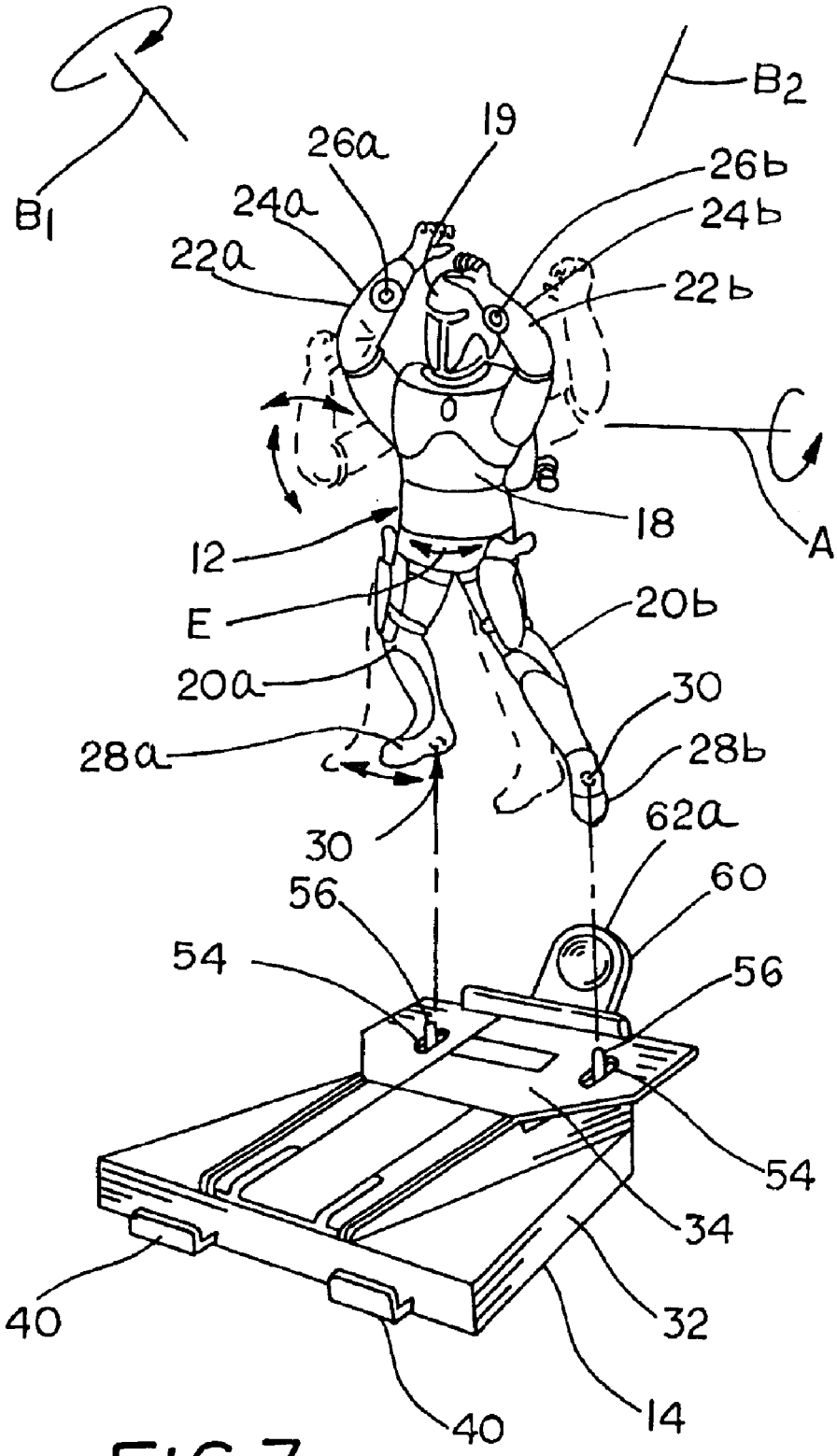
FIG. 3 a perspective view of an exemplary form of a launching pad for use in launching the figure.

Referring now to FIGS. 1, 2 and 3 of the drawings, a toy assembled in accordance with the teachings of the present invention and generally referred to by the reference numeral 10 is shown and includes a simulated climbing FIG. 12. The toy 10 also includes a launching unit 14 and a structure 16 (FIGS. 1 and 2). The structure 16 may be placed in fixed relationship relative to the launching unit 14 as will be explained in greater detail below or, as an alternative, may be detached from the launching unit 14 and placed at any desired location.

The FIG. 12 includes a body 18 having a head 19, a pair of legs 20*a*, and 20*b*, and a pair of arms 22*a* and 22*b*. Preferably, each of the arms 22*a* and 22*b* may be constructed such that the arms 22*a*, 22*b* will pivot roughly at the shoulders about a generally horizontal axis A when the FIG. 12 is positioned as shown in FIG. 1. Still preferably, each of the arms 22*a*, 22*b* may include a forearm 24*a*, 24*b*, respectively. In the disclosed example, the forearms 24*a*, 24*b* will preferably each pivot about an axis B1, B2, respectively. It will be appreciated that the position of the axes B1, B2 will change in response to the pivoting of the arms 22*a*, 22*b* about the axis A.

It will be understood that the FIG. 12 may also include other features conventionally employed in the construction of action figures. For example, the body 18 of the FIG. 12 may pivot roughly around the waist, and each of the legs 20*a*, 20*b* may pivot roughly at the hips as indicated at E in FIG. 3. The legs 20*a*, 20*b* may also be configured to pivot at the knees. Other forms for the FIG. 12 may be used.

Further, each of the forearms 24*a*, 24*b* is provided with a magnet 26*a*, 26*b*, respectively. It will be appreciated that by rotating the forearms 24*a*, 24*b* about the axes B1, B2, respectively, and by rotating the arms 22*a*, 22*b* about the axis A, the position and angle of the magnets 26*a*, 26*b* may be adjusted as desired. The FIG. 12 also includes a pair of feet 28*a*, 28*b* attached to the legs 20*a*, 20*b*, respectively. Each of the feet 28*a*, 28*b* is preferably provided with a hole 30 (viewable in FIGS. 2 and 3, as well as is FIG. 4).

Figure 8:
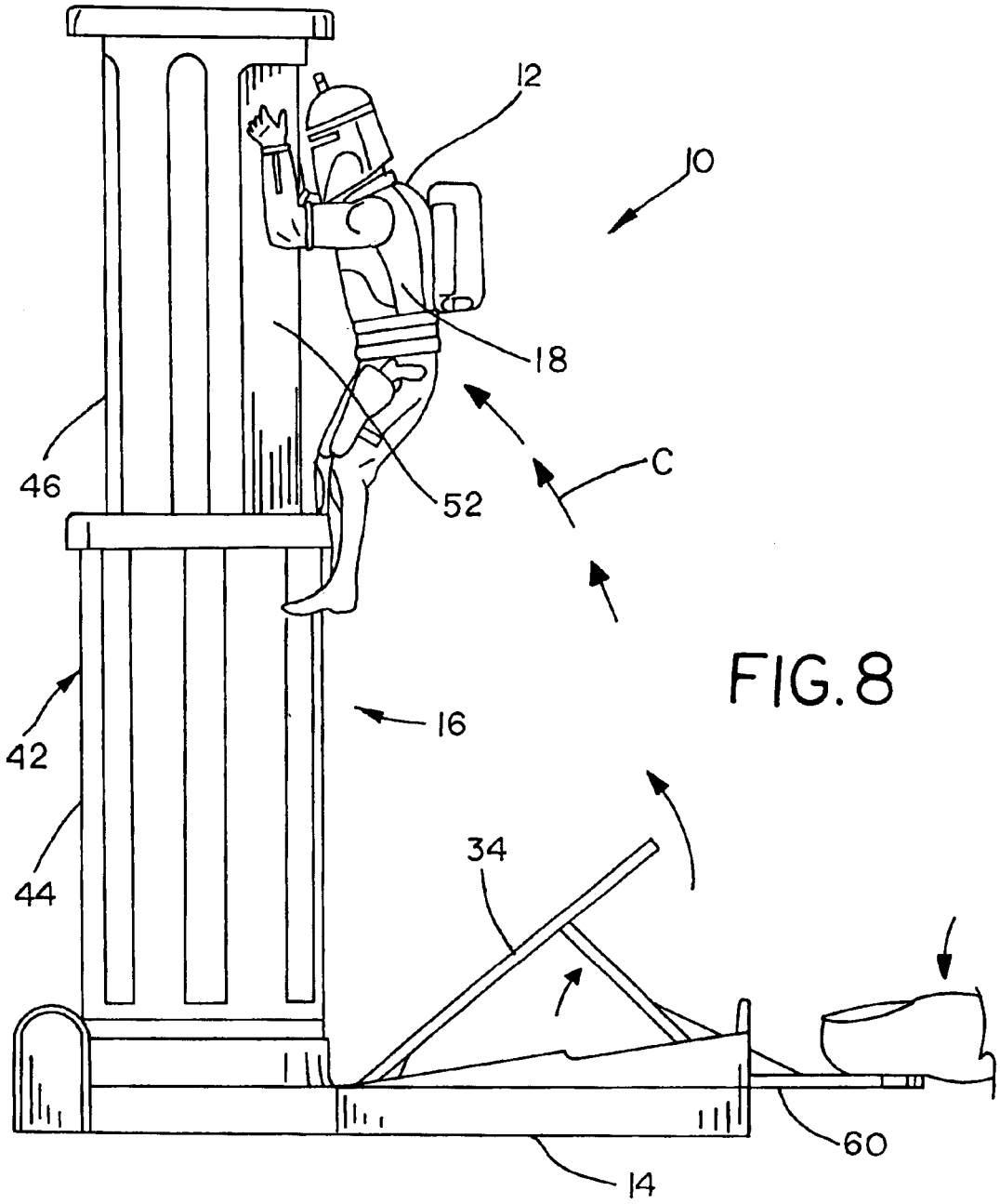
FIG. 8 is an elevational view of the figure shown after launching an in contact with the structure.

Referring still to FIGS. 1–3, the launching unit 14 includes a base 32 having a platform 34 which is sized and shaped to support the FIG. 12. In FIGS. 1–3, the platform 34 is shown in a lowered or stationary position. A shown in FIGS. 4 and 5, the platform 34 is connected to the base 32 by a pivot 36, such that the platform 34 may shift between the stationary position of FIGS. 1–4 and a launch position as shown in FIGS. 5 and 8 in a manner to be explained in greater detail below.

The structure 16 includes a base 38 which may be releasably mounted to the base 32 of the launching unit 14 by one or more latches 40. In the disclosed example, the structure 16 takes the form of a column 42 having a lower portion 44 and an upper portion 46. A base 48 of the column 42 may be releasably attached to a receiving part 50 formed in the base 38 of the structure 16. The receiving part may take the form of an aperture in the base 48, which is sized to frictionally receive the base of the lower portion 44 to retain the lower portion 44 (and hence the upper portion 46) on the base 38 of the structure 16.

The upper portion 46 of the column 42 includes a ferrous metal surface 52 which, in the disclosed example is positioned in a generally vertical configuration. It would be appreciated that the metal surface 52 may be formed either by providing the metal on the surface of the upper portion 46 of the column 42, or as an alternative, the metal may be placed inside the surface of the upper portion 46 of the column 42 beneath a layer of overlying material, such as a thin player of plastic. In the disclosed example, the surface 52 is generally curved and follows the contours of the generally round column 42, but may take other forms. It will also be appreciated that the structure 16 may be constructed as a single unit, or in a variety of other forms different than the column shown as may be desired by the manufactured.

Referring now to FIG. 3, the platform 34 of the base 32 preferably includes a pair of apertures or slots 54. The base 38 of the platform 34 preferably includes a pair of pins 56 which are mounted to the base and extend generally upwardly through the slots 54 in the platform 34. The pins 56 are preferably sized to frictionally engage the holes 30 provided in the feet 28*a*, 28*b* of the FIG. 12, to thereby form a releasable connection 58 which, in the disclosed example, serves to retain the FIG. 12 on the platform 34 of the launching unit 14 when the platform is in the stationary position. It will be appreciated that the releasable connection 58 between the FIG. 12 and the launching unit 14 may take a number of forms, such as, by way of example rather that limitation, a magnetic connection, a hook and loop closure connection, or any other suitable releasable connection that will enable the FIG. 12 to become detached from the launching unit 14 when the FIG. 12 is activated as explained below.

Figure 4:
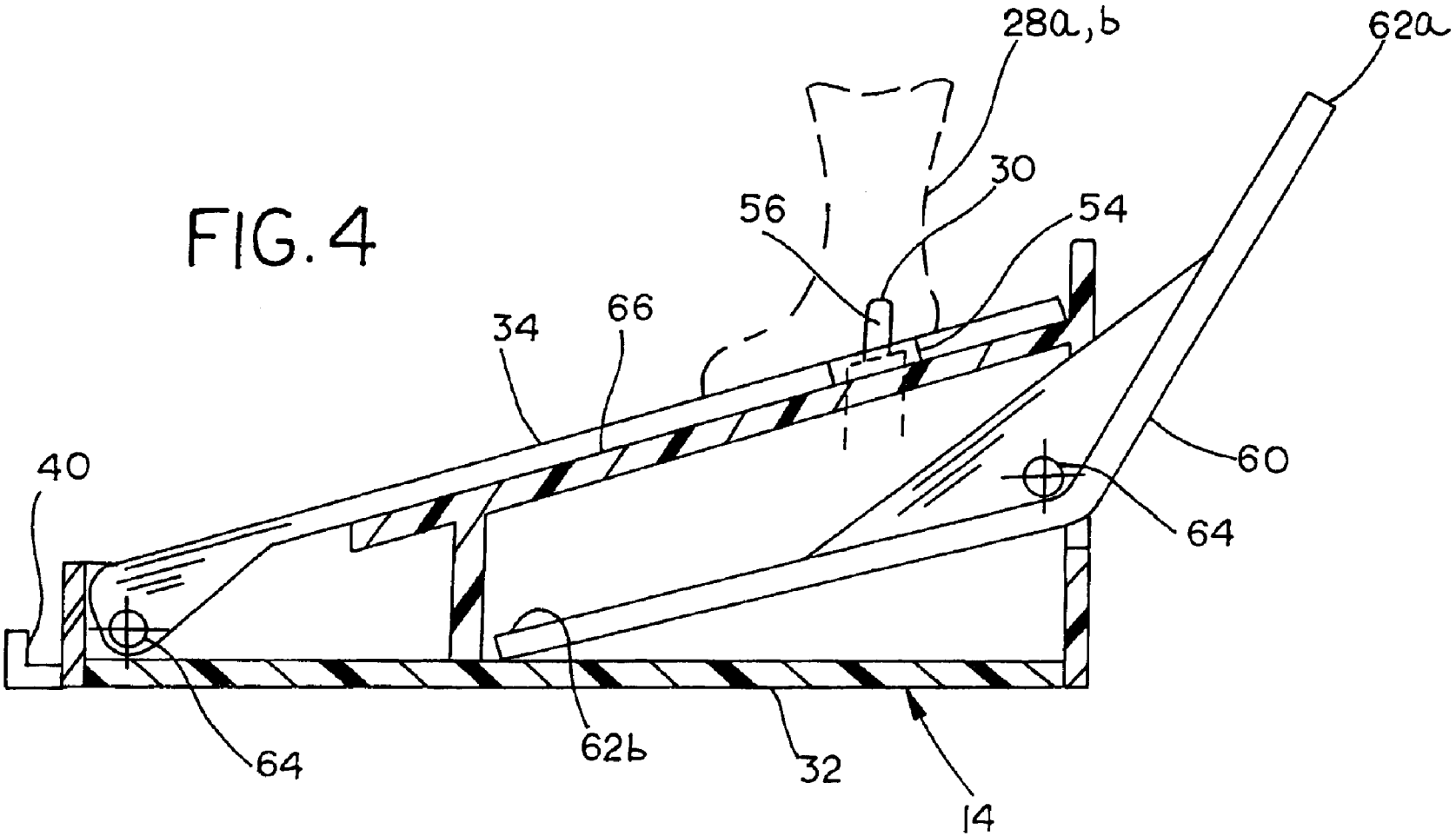
FIG. 4 is an enlarged cross-sectional view of the launching pad of FIG. 3 and in which the launching pad is shown in a first position.
Figure 5:
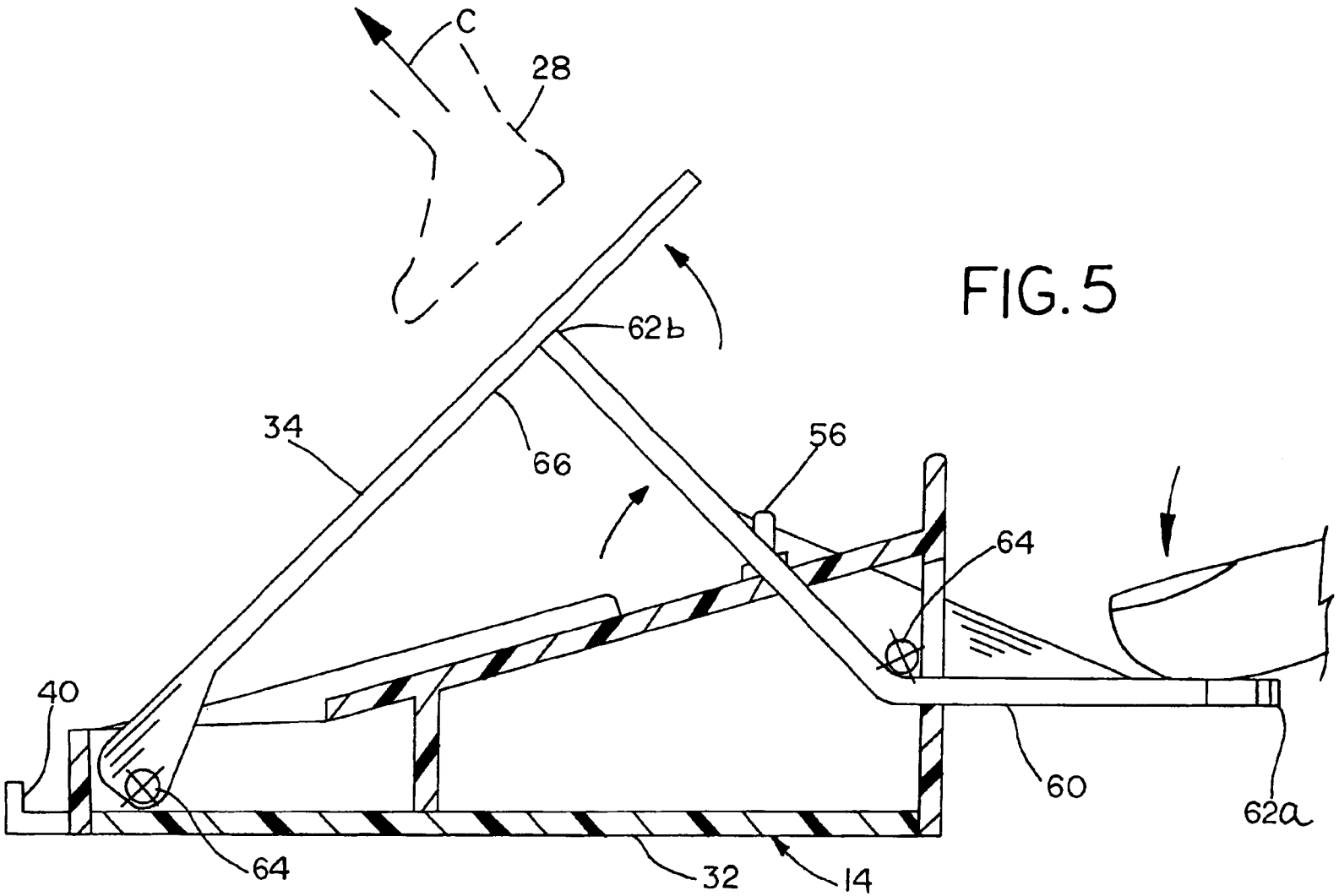
FIG. 5 is an enlarged cross-sectional view similar to FIG. 4 and illustrating the launching pad shifted to a launch position to launch the figure.

Referring now to FIGS. 4 and 5, the launching unit 14 is shown in enlarged cross-sectional form therein. The launching unit 14 includes an actuating lever 60. The actuating lever 60 includes a pair of ends 62*a* and 62*b*, and is shiftable about a pivot 64. It will be appreciated that the end 62*a* is angled generally upwardly when viewing FIG. 4 and is sized to be actuated by a user as shown in FIG. 5. The end 62*b* of the actuating lever 60 is positioned to cam against an underside 66 (or any other suitable portion) of the platform 34 as shown in FIG. 5, such that the platform 34 will shift between the stationary position of FIG. 4 toward the launch position illustrated in FIG. 5.

It will also be appreciated that upon application of a suitable actuating force provided by a user as shown in FIG. 5, that the platform 34 will pivot sufficiently rapidly about the pivot 36 so as to cause the FIG. 12 to be launched along a trajectory C. It will also be appreciated that upon the pivoting of the platform 34 about the pivot 36, that the pins 56 in the launching unit 14 will become disengaged from the holes 30 in the feet 28*a*, 28*b* of the FIG. 12.

Figure 6:
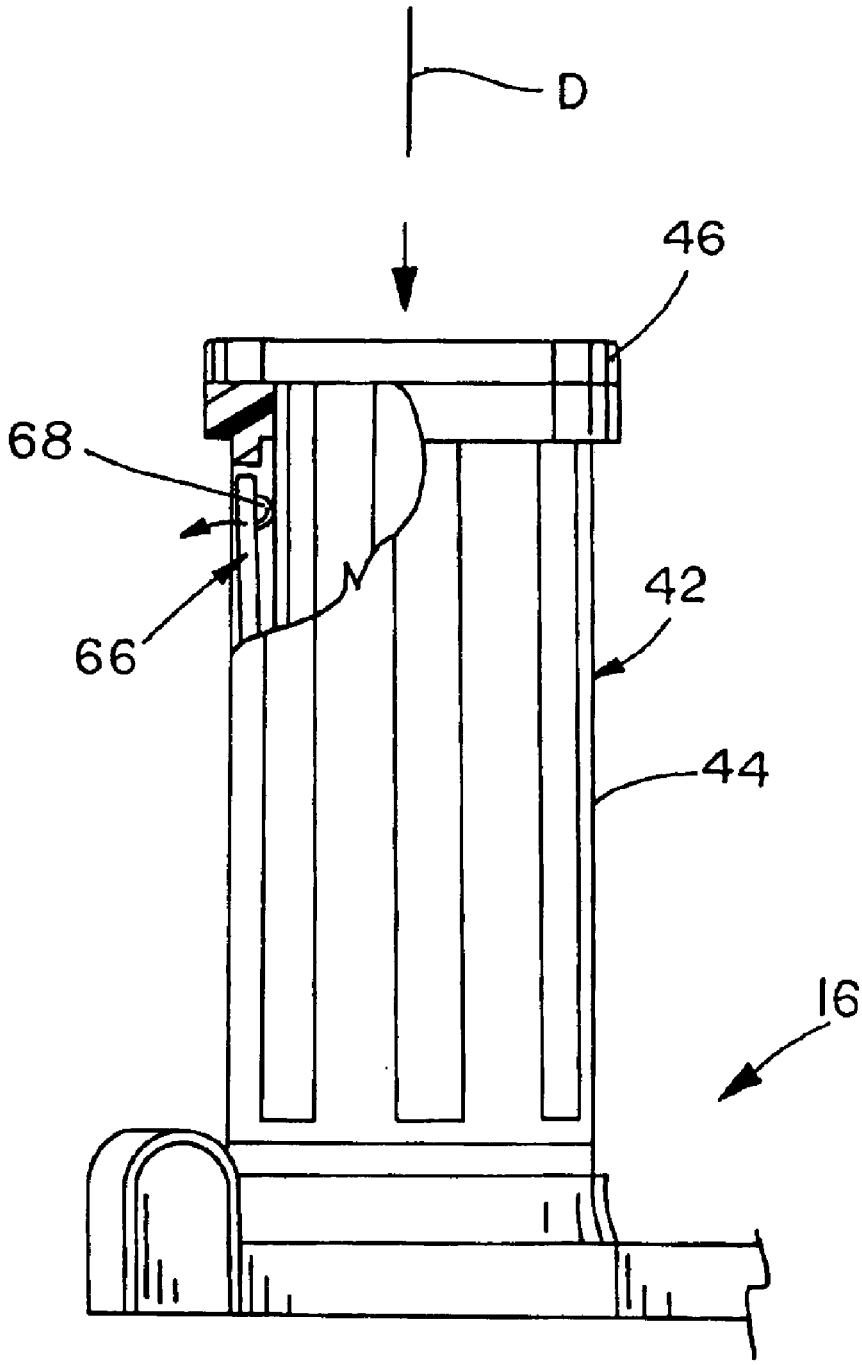
FIG. 6 is an elevational view of an exemplary column structure.
Figure 7:
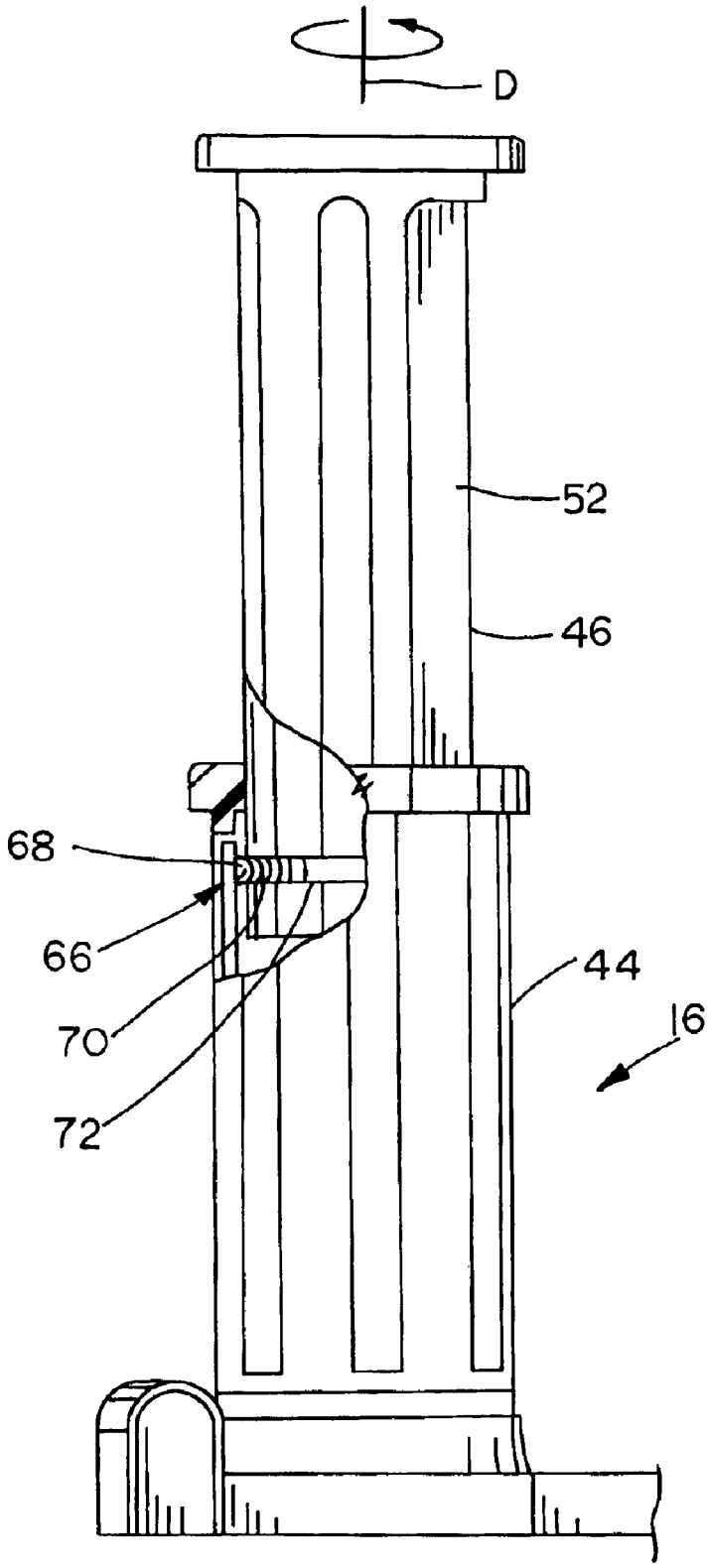
FIG. 7 is an elevational view of the column structure of FIG. 6 shown in an extended position.

Referring now to FIGS. 6 and 7, it will be appreciated that the column 42 may be shiftable between the lowered position as shown in FIG. 6 and the extended or raised position as shown in FIG. 7. The column 42 also may be provided with a shiftable latch 66 having a protrusion 68 which is sized to releasably engage a depression 70 in the upper portion 46 of the column 42. In the disclosed example, the depression 70 is provided in the form of a ring 72 which extends generally about the outer circumference of the upper portion 46 of the column 42. Thus, the ring and the protrusion 68 will permit the upper portion 44 of the column 42 to rotate about a generally vertical axis D relative to the lower portion 44 of the column 42. Accordingly, the direction that the metal surface 52 faces at any point in time may be adjusted as desired by the user.

Referring now to FIG. 8, the toy 10 is shown with the FIG. 12 having been launched along the trajectory C toward the column 42 of the structure 16. The platform 34 of the launching unit 14 is shown in the launched position having been pivoted about the pivot 36 upon the application of a suitable downward force to the end 62*a* of the actuating lever 60 by the user. It will be appreciated that the magnets 26*a* and 26*b* on the forearms 24*a*, 24*b* of the FIG. 12 have come into magnetic engagement with the metal surface 52 of the column 42. Upon launching the FIG. 12 along the trajectory C such that it engages the column 42 and is engaged thereby or otherwise retained thereon, the FIG. 12 may be viewed as simulating a climbing action.

It will also be appreciated that the trajectory C may be altered as may the relative position of the structure 16 to the launching unit 14, such as by disengaging the latch 40 which holds the structure 16 and the launching unit 14 in the fixed relationship shown in FIG. 8. It will also be appreciated that other portions of the FIG. 12 may be provided with magnets as desired. For example, each of the legs 20*a*, 20*b* may be provided with magnets, and/or the body 18 may be provided with magnets. It will also be appreciated that the magnets 26*a*, 26*b* and the metal surface 52 may be replaced and/or supplemented with other suitable engaging mechanisms, such as, by way of example rather that limitation, hook and loop closures, releasable adhesives, or any other suitable mechanism. Alternatively, the arms on the FIG. 12 may be made of a ferrous metal and the surface 52 may include a magnet or be magnetizable. Still further, the magnets 26*a*, 26*b* may be comprised of magnets having a first polarity, while the surface 52 may be formed of a surface having the opposite polarity, such that the surface 52 and the magnets 26*a*, 26*b* may be suitably attracted to each other. In the disclosed example, the arms 22*a*, 22*b* may be adjusted as outlined above about the axes A, $B_1$ and/or $B_2$ in order to position the magnets 26*a*, 26*b* so as to conform to the surface 52, or to otherwise best position the magnets 26*a*, 26*b* such that the FIG. 12 will be retained on the structure 16. The adjustability of the arms 22*a*, 22*b* permits the arms and hence the magnets 26*a*, 26*b* to generally conform to or be complementary to the surface contours of the structure 16.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A toy having a simulated climbing figure and comprising:

a figure including a portion having at least one of a magnet and a ferrous metal element;

a launching unit including a platform for receiving the figure, the platform shiftable between a stationary position and a launch position to permit the figure to be launched from the launching unit along a trajectory exclusively under the power of the launching unit;

a structure placeable in the trajectory and having a generally vertical component, the structure having a surface portion comprising at least one of a magnet and a ferrous metal element disposed generally adjacent the generally vertical component, the portion of the figure and the surface portion of the structure arranged to enable the figure to be retained on the structure.

2. The toy of claim 1, the launching unit including a base and the platform pivotally mounted to the base, and including an actuating lever arranged to shift the platform from the stationary position to the launch position.

3. The toy of claim 2, wherein the actuating lever is pivotally mounted to the base and includes a camming portion that operatively engages the platform.

4. The toy of claim 1, wherein the figure and the launching unit are provided with cooperating pin-in-hole connections to retain the figure on the launching unit when the platform is in the stationary position.

5. The toy of claim 1, wherein the launching unit and the structure include cooperating connections to retain the structure in a fixed position relative to the launching unit.

6. The toy of claim 1, wherein the figure includes a pair of arms and the portion of the figure comprises a magnet disposed on each of the arms, and wherein the surface portion of the structure comprises a ferrous metal element.

7. The toy of claim 1, wherein the structure comprises a column.

8. The toy of claim 7, wherein the column includes a lower portion and a telescoping upper portion, the upper portion shiftable between a lowered position in which at least a part of the upper portion is disposed inside of the lower portion and a raised position in which the upper portion extends from the lower portion.

9. The toy of claim 8, wherein the structure includes a catch to retain the upper portion in the raised position.

10. The toy of claim 8, wherein the upper portion is rotatable relative to the lower portion.

11. A toy comprising:

a figure;

a launching unit including a platform for receiving the figure, the platform shiftable between a stationary position and a launch position to permit the figure to be springlessly launched from the launching unit along a trajectory;

a structure placeable in the trajectory and having a generally vertical component; and each of the figure and the vertical component of the structure provided with cooperating engaging elements, the engaging elements arranged to enable the figure to be retained on the vertical component of the structure.

12. The toy of claim 11, wherein the platform is pivotally mounted to the launching unit, the launching unit including an actuating lever arranged to shift the platform from the stationary position to the launch position.

13. The toy of claim 12, the platform including a base, the actuating lever pivotally mounted to the base, the actuating lever having a camming portion arranged to operatively engage the platform to thereby shift the platform to the launch position.

14. The toy of claim 11, wherein cooperating portions of the figure and the launching unit are arranged to retain the figure on the launching unit when the platform is in the stationary position.

15. The toy of claim 11, wherein the launching unit and the structure include cooperating connections to retain the structure in a fixed position relative to the launching unit.

16. The toy of claim 11, wherein the figure includes a pair of arms and the cooperating elements of the figure and the structure comprise magnets, the figure having a magnet disposed on each of the arms, and wherein each of the arms is pivotable to permit the magnets to be moved to different positions.

17. The toy of claim 11, wherein the structure comprises a column having a lower portion and a telescoping upper portion, the upper portion shiftable between a lowered position in which at least a part of the upper portion is disposed inside of the lower portion and a raised position in which the upper portion extends from the lower portion.

18. The toy of claim 17, wherein the upper portion of the structure is cylindrical.

19. The toy of claim 18, wherein the upper portion is rotatable relative to the lower portion.

20. A toy comprising:

a figure having a pair of moveable limbs and at least one springless limb;

a launching unit including a platform for supporting the figure, the platform including a lever arranged to shift the platform between a stationary position and a launch position to permit the figure to be launched via the springless limb from the launching unit along a trajectory;

a receiving structure placeable in the trajectory and having a surface arranged to receive the limbs of the figure; and the figure and the surface of the structure provided with cooperating engaging elements, the engaging elements arranged to enable the figure to be retained on the surface of the structure.

* * * * *

UNITED STATES PATENT AND TRADEMARK OFFICE

CERTIFICATE OF CORRECTION

PATENT NO. : 6,860,787 B1
DATED : March 1, 2005
INVENTOR(S) : Hampton R. Woodhouse It is certified that error appears in the above-identified patent and that said Letters Patent is hereby corrected as shown below:

Column 6,
Line 57, please delete "the figure" and insert -- the moveable limbs of the figure -- in its place.

Signed and Sealed this

Thirteenth Day of December, 2005

JON W. DUDAS
*Director of the United States Patent and Trademark Office*